US009214738B2

(12) United States Patent
Yehezkely

(10) Patent No.: US 9,214,738 B2
(45) Date of Patent: Dec. 15, 2015

(54) ANTENNA ARRAY CONNECTIVITY LAYOUT AND A METHOD FOR DESIGNING THEREOF

(75) Inventor: Alon Yehezkely, Haifa (IL)

(73) Assignee: QUALCOMM INCORPORATED, San Diego, CA (US)

( * ) Notice: Subject to any disclaimer, the term of this patent is extended or adjusted under 35 U.S.C. 154(b) by 326 days.

(21) Appl. No.: 13/544,425

(22) Filed: Jul. 9, 2012

(65) Prior Publication Data

US 2014/0009364 A1 Jan. 9, 2014

(51) Int. Cl.

| | |
|---|---|
| ***H01Q 21/00*** | (2006.01) |
| ***H01Q 21/06*** | (2006.01) |
| ***H01Q 23/00*** | (2006.01) |

(52) U.S. Cl.

CPC ..... *H01Q 21/0006* (2013.01); *H01Q 21/0075* (2013.01); *H01Q 21/06* (2013.01); *H01Q 23/00* (2013.01); *Y10T 29/49016* (2015.01)

(58) Field of Classification Search

USPC ..... 343/893, 879, 853

See application file for complete search history.

(56) References Cited

U.S. PATENT DOCUMENTS

| | | | | |
|---|---|---|---|---|
| 2009/0167611 | A1 | 7/2009 | Hsu et al. | |
| 2010/0079343 | A1 | 4/2010 | Hsu et al. | |
| 2010/0127941 | A1 | 5/2010 | Chiang et al. | |
| 2011/0075581 | A1 | 3/2011 | Mihota | |
| 2011/0075747 | A1 | 3/2011 | Mihota | |
| 2011/0098010 | A1 | 4/2011 | Mihota | |
| 2011/0169709 | A1* | 7/2011 | Cooper | 343/841 |
| 2011/0227588 | A1 | 9/2011 | Chen et al. | |
| 2011/0273384 | A1 | 11/2011 | Yeh et al. | |

* cited by examiner

*Primary Examiner* — Dieu H Duong

(57) ABSTRACT

An antenna array connectivity circuit of a millimeter-wave RF module comprises a multilayer substrate having a rectangular layout; a plurality of triangular antenna edge blocks having a triangular layout arranged in the multilayer substrate such that a base of each triangular antenna edge block of the plurality of triangular antenna edge blocks is parallel to an edge of the multilayer substrate and a vertex of each triangular antenna edge block points to a center of the multilayer substrate; a plurality of antenna interfaces arranged in the multilayer substrate such that each antenna interface of the plurality of antenna interfaces lays parallel to a base of a respective triangular antenna edge block and in a perimeter of one edge of the rectangular layout; and a signal distribution network lays in the center of the multilayer substrate such that a separation is created between two groups of triangular antenna edge blocks.

19 Claims, 7 Drawing Sheets

ANTENNA ARRAY CONNECTIVITY LAYOUT AND A METHOD FOR DESIGNING THEREOF

TECHNICAL FIELD

The present invention generally relates to millimeter wave radio frequency (RF) systems, and more particularly to efficient design layouts of antenna array connectivity modules in such systems.

BACKGROUND

The 60 GHz band is an unlicensed band which features a large amount of bandwidth and a large worldwide overlap. The large bandwidth means that a very high volume of information can be transmitted wirelessly. As a result, multiple applications, each requiring transmission of large amounts of data, can be developed to allow wireless communication around the 60 GHz band. Examples for such applications include, but are not limited to, wireless high definition TV (HDTV), wireless docking stations, wireless Gigabit Ethernet, and many others.

In order to facilitate such applications there is a need to develop integrated circuits (ICs), such as amplifiers, mixers, radio frequency (RF) analog circuits, and active antennas that operate in the 60 GHz frequency range. An RF system typically comprises active and passive modules. The active modules (e.g., a phase-array antenna) require control and power signals for their operation, which are not required by passive modules (e.g., filters). The various modules are fabricated and packaged as RFICs that can be assembled on a printed circuit board (PCB). The size of the RFIC package may range from several to a few hundred square millimeters.

In the consumer electronics market, the design of electronic devices, and thus RF modules integrated therein, should meet the constraints of minimum cost, size, power consumption, and weight. The design of the RF modules should also take into consideration the current assembled configuration of electronic devices, and particularly handheld devices, such as laptop and tablet computers in order to enable efficient transmission and reception of millimeter wave signals. Furthermore, the design of the RF module should account for minimal power loss of receive and transmit RF signals and for maximum radio coverage.

A schematic diagram of an RF module 100 designed for transmission and reception of millimeter wave signals is shown in FIG. 1. The RF module 100 includes an array of active antennas 110-1 through 110-N connected to an RF circuitry 120. Each of the active antennas 110-1 through 110-N may operate as transmit (TX) and/or receive (RX) antennas. An active antenna can be controlled to receive/transmit radio signals in a certain direction, to perform beam forming, and for switching from receive to transmit modes. For example, an active antenna may be a phased array antenna in which each radiating element can be controlled individually to enable the usage of beam-forming techniques.

In the transmit mode, the RF circuitry 120 typically performs up-conversion, using a mixer (not shown in FIG. 1), to convert intermediate frequency (IF) signals to radio frequency (RF) signals. Then, the RF circuitry 120 transmits the RF signals through the TX antenna according to the control of the control signal. In the receive mode, the RF circuitry 120 receives RF signals through the active RX antenna and performs down-conversion, using a mixer, to IF signals using the local oscillator (LO) signals, and sends the IF signals to a baseband module (not shown in FIG. 1).

In both modes, the operation of the RF circuitry 120 is controlled by the baseband module using a control signal. The control signal is utilized for functions, such as gain control, RX/TX switching, power level control, beam steering operations, and so on. In certain configurations, the baseband module also generates the LO and power signals and transfers such signals to the RF circuitry 120. The power signals are DC voltage signals that power the various components of the RF circuitry 120. It should be noted that the IF signals are also transferred between the baseband module and the RF circuitry 120.

Typically, the RF circuitry 120 is implemented and fabricated as a single integrated circuit (IC), while the array of active antennas 110-1 to 110-N are externally connected to the IC. The antennas are printed on the substrate upon which the IC of the RF circuitry 120 is also mounted. The multilayer substrate, which is a combination of metal and dielectric layers can be made of materials, such as a laminate (e.g., FR4 glass epoxy, Bismaleimide-Triazine), ceramic (e.g., low temperature co-fired ceramic LTCC), polymer (e.g., polyimide), PTFE (Polytetrafluoroethylene) based compositions (e.g., PTFE/Cermaic, PTFE/Woven glass fiber), and Woven glass reinforced materials (e.g., woven glass reinforced resin), wafer level packaging, and other packaging, technologies and materials. Thus, additional circuitry is required to allow proper connectivity between the antennas and the IC (chip) of the RF circuitry. With this aim, the RF circuitry 120 typically includes, for each active antenna 110, an antenna edge block through an antenna interface. The antenna interface is an implementation of chip-board transition structure, which typically includes the IC (chip) package and transmission lines from the IC to the substrate. Additionally, circuits designed for impedance matching and electrostatic discharge (ESD) protection may be also part of the antenna interface.

A schematic illustration of an antenna edge block 210 that is part of an RF module 200 is provided in FIG. 2. The antenna edge block 210 includes an amplifier, such as a low-noise amplifier (LNA) 211, phase shifters 212, and switches 213 to switch between receive and transmit modes. The phase shifters 212 allow steering the direction of an active antenna 231. The combiner 221, distributer 222, mixers 223, 224, and amplifiers 225 are components of the RF circuitry 220. The mixer 223 performs up-conversion, while the mixer 224 performs down-conversion.

FIG. 3 shows a conventional IC layout 300 of an antenna array connectivity which is part of an RF circuitry (e.g., RF circuitry 120). The layout 300 is an arrangement of eight (8) antenna edge blocks 310-1 through 310-8 in a rectangular layout. The antenna edge blocks 310-1 through 310-8 are placed on the edges of the layout 300, each of which is connected to an active antenna through a respective antenna interface **320-*i* (i=1, . . . , 8). The active antennas are not part of the layout 300 and are not shown in FIG. 3. An antenna edge block 310-*i* may be implemented as shown in the exemplary FIG. 2**.

In conventional IC design techniques, the layout of an antenna edge block is always rectangular. Each edge block **310-*i* is further connected to a signal distribution network 330, through which the receive/transmit radio signals are transferred from and to the antennas. The signal distribution network 330 is comprised of a transmission line and a plurality of splitter elements. A splitter is a passive element connected in each junction 331 of the signal distribution network 330**. The splitter performs the functions of combining signals received from two or more different branches of the transmission line or splitting a signal to two or more different branches.

There are a number of disadvantages with the conventional layout of the antenna array connectivity, hence the RF circuitry. One disadvantage is that the size of the signal distribution network 330 is relatively big and usually occupies as much as one third of the area of the entire IC design of the RF circuitry 120. Further, the distribution network 330 includes at least one splitter element per each pair of antenna edge blocks in addition to a splitter element for splitting/summing a signal to opposite sides of the rectangular layout. A signal splitter performs the functions of splitting signals in the receive direction and summing signals in the transmit direction.

The implementation of each splitter introduces signal losses which are accumulated as with the number of splitters in cascade. For example, a single 2-way splitter element attenuates 60 GHz signals in 1 db, and a cascade of three such splitters (providing 8-way split) will result in 3 dB loss. Further, analog beam-forming requires that all receive/transmit signals are summed/split to/from a single point, e.g., a feed point 340. This requirement constrains the routing options from the feed point 340 to each antenna.

As a result of these constraints, the number of active antennas that can be connected to the RF module is limited. An attempt to increase the number of active antennas would require increasing the size of the design of the RF circuitry (i.e., the size of the IC). Also, such an attempt would require increasing the length of the wires (traces) from the feed point 340 to each antenna edge block 310-*i* as well as increasing the number of splitter elements in the distribution network 330 with high numbers of splitter elements, hence resulting in higher signal losses.

To compensate for signal losses, signal amplification using active device amplifiers is typically performed. However, this complicates the design of an antenna edge block, limits the performance of the RF module, and may not meet the constraints of an efficient design. Such constraints necessitate that the physical dimensions, the power consumption, heat transfer, and cost should be as minimal possible. In addition, the routing of signals between the antennas to the RF circuitry 120 should be as short as possible to reduce energy losses of RF signals.

It would be therefore advantageous to provide an efficient IC layout design for an antenna array connectivity that overcomes the disadvantages of conventional layout design.

SUMMARY

Certain embodiments disclosed herein include an antenna array connectivity circuit layout of a millimeter-wave radio frequency (RF) module. The circuit layout comprises a rectangular layout configured to arrange circuits enabling connectivity to an array of active antennas; a plurality of triangular antenna edge blocks having a triangular layout arranged in the rectangular layout such that a base of each triangular antenna edge block of the plurality of triangular antenna edge blocks is parallel to an edge of the rectangular layout and a vertex of each triangular antenna edge block points to a center of the rectangular layout; a plurality of antenna interfaces arranged in the rectangular layout such that each antenna interface of the plurality of antenna interfaces lays parallel to a base of a respective triangular antenna edge block and in a perimeter of one edge of the rectangular layout; and a signal distribution network lays in the center of the rectangular layout such that a separation is created between two groups of triangular antenna edge blocks.

Certain embodiments disclosed herein also include a method for designing layout of an antenna array connectivity layout of a millimeter-wave radio frequency (RF) module. The circuit layout comprises creating a rectangular layout; arranging a plurality of triangular antenna edge blocks having a triangular layout in the rectangular layout, wherein the plurality of triangular antenna edge blocks are arranged such that a base of each triangular antenna edge block of the plurality of triangular antenna edge blocks is parallel to an edge of the rectangular layout and a vertex of each triangular antenna edge block points to a center of the rectangular layout; arranging a plurality of antenna interfaces in the rectangular layout such that each antenna interface of the plurality of antenna interfaces lays parallel to a base of a respective triangular antenna edge block and in a perimeter of one edge of the rectangular layout; creating a signal distribution network; and arranging the signal distribution network in the center of the rectangular layout such that a separation is created between two groups of triangular antenna edge blocks.

Certain embodiments disclosed herein also include an antenna array connectivity circuit of a millimeter-wave radio frequency (RF) module. The antenna array connectivity circuit comprises a multilayer substrate having a rectangular layout; a plurality of triangular antenna edge blocks having a triangular layout arranged in the multilayer substrate such that a base of each triangular antenna edge block of the plurality of triangular antenna edge blocks is parallel to an edge of the multilayer substrate and a vertex of each triangular antenna edge block points to a center of the multilayer substrate; a plurality of antenna interfaces arranged in the multilayer substrate such that each antenna interface of the plurality of antenna interfaces lays parallel to a base of a respective triangular antenna edge block and in a perimeter of one edge of the rectangular layout; and a signal distribution network lays in the center of the multilayer substrate such that a separation is created between two groups of triangular antenna edge blocks.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention will be apparent from the following detailed description taken in conjunction with the accompanying drawings.

DETAILED DESCRIPTION

Figure 1:
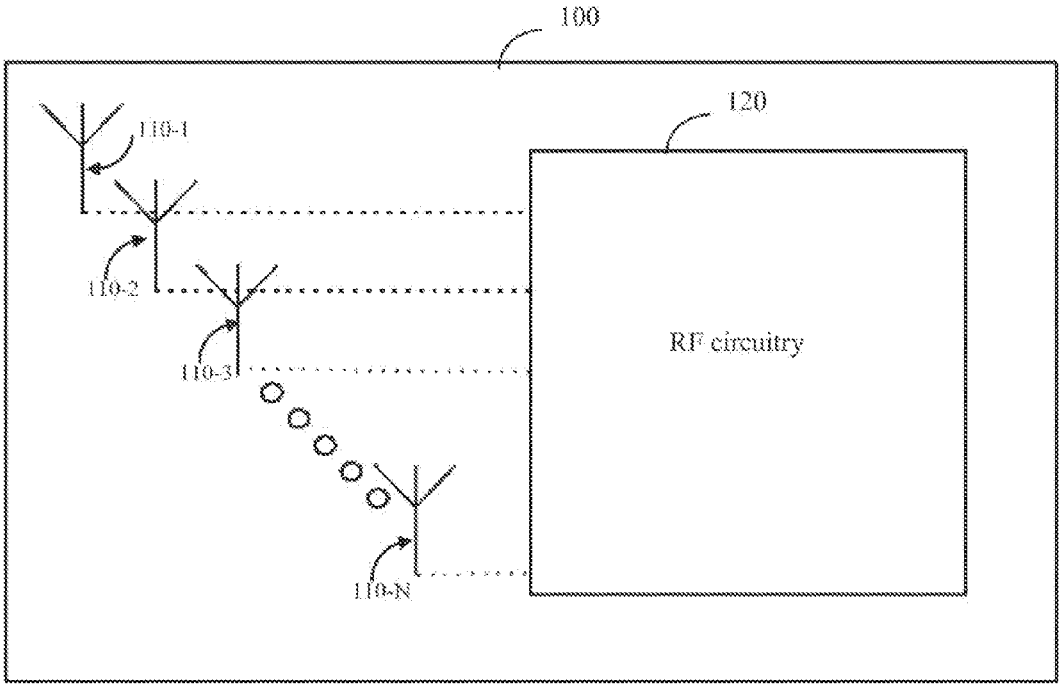
FIG. 1 PRIOR ART
FIG. 1 is a diagram illustrating an RF module with an array of active antennas.

The embodiments disclosed are only examples of the many possible advantageous uses and implementations of the innovative teachings presented herein. In general, statements made in the specification of the present application do not necessarily limit any of the various claimed inventions. Moreover, some statements may apply to some inventive features but not to others. In general, unless otherwise indicated, singular elements may be in plural and vice versa with no loss of generality. In the drawings, like numerals refer to like parts through several views.

Figure 4:
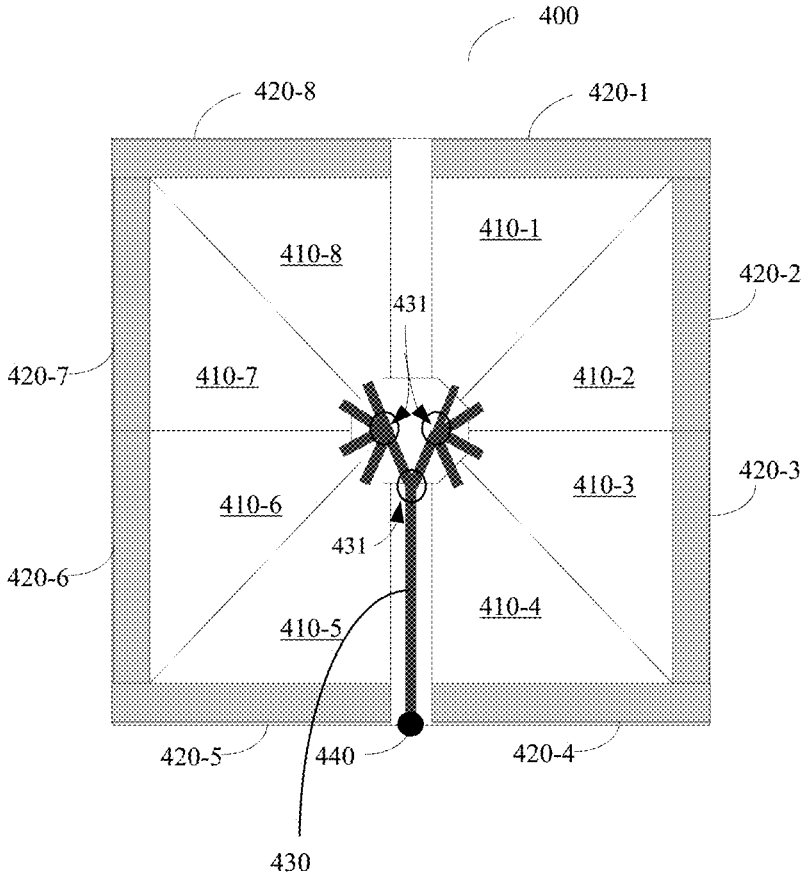
FIG. 4 illustrates an IC layout of antenna array connectivity according to one embodiment.

FIG. 4 shows an exemplary and non-limiting diagram of an IC layout of antenna array connectivity designed according to one embodiment. The antenna array connectivity is part of an RF circuitry utilized in an RF module and enables connectivity to an array of active antennas. In an exemplary embodiment, the RF module is part of a millimeter wave radio system that transmits and receives wireless signals over the 60 GHz frequency band. As described above with reference to FIG. 1, the RF module includes an RF circuitry (e.g., circuitry 120) and an array of active antennas. The active antennas implement analog beam-forming to receive and transmit radio signals.

According to various embodiments disclosed herein, the layout 400 allows the connection of more active antennas to the RF module within a smaller amount of space. Thus, the layout disclosed herein enables design and fabrication of smaller size RFICs utilized in RF modules. The disclosed layout 400 further allows signal distribution using a simple distribution network with less signal routing and a smaller number of signal splitter elements, thus the signal losses are reduced.

Figure 2:
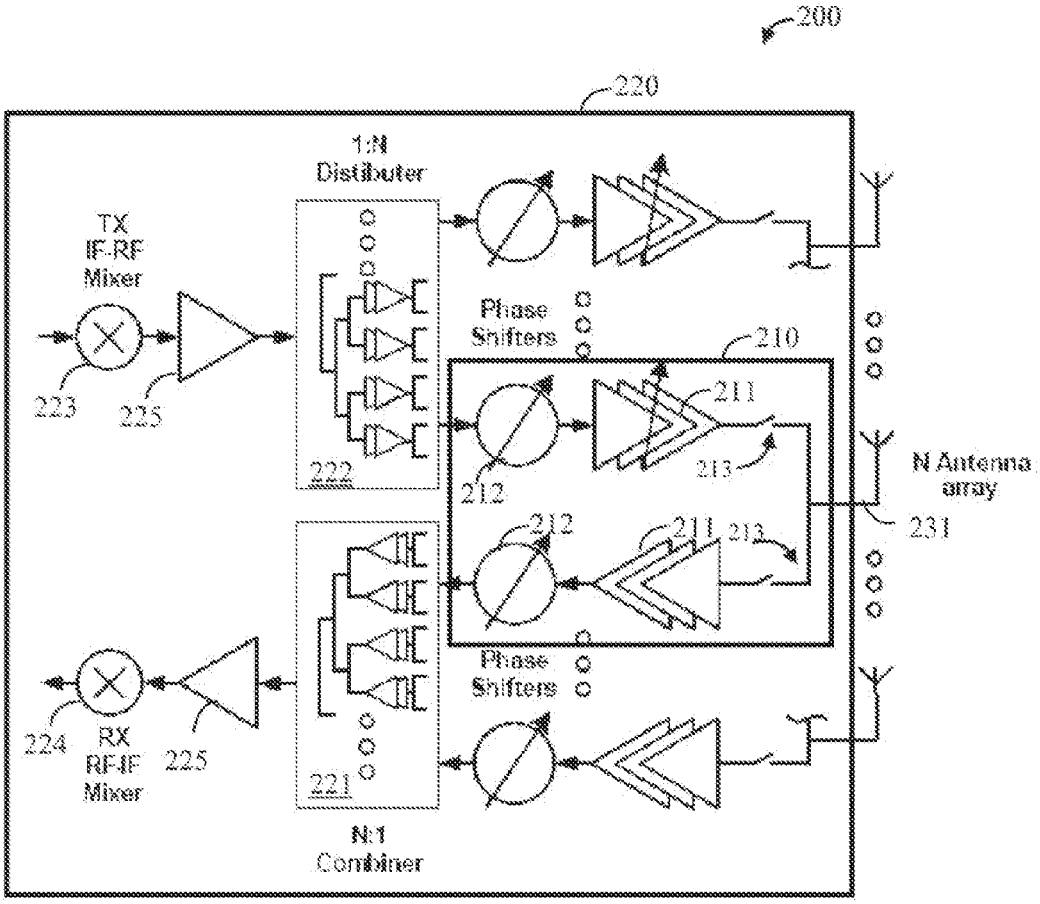
FIG. 2 PRIOR ART
FIG. 2 is a diagram of an RF circuitry including an antenna edge block.
Figure 3:
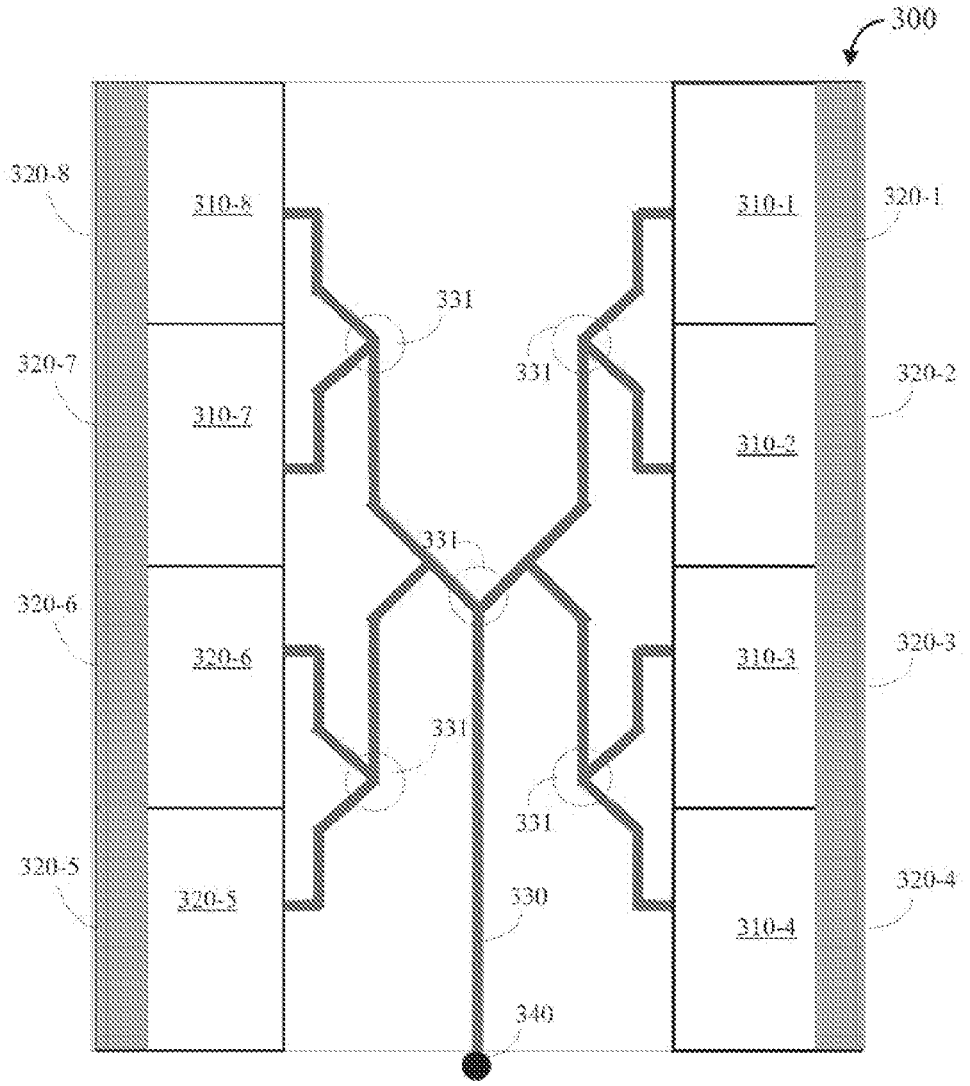
FIG. 3 PRIOR ART
FIG. 3 illustrates a conventional IC layout of antenna array connectivity.

As illustrated in the exemplary and non-limiting FIG. 4, eight (8) antenna edge blocks 410-1 through 410-8 are arranged in a rectangular layout 400 around all edges of the rectangle. In contrast to conventional layout designs, each layout of an antenna edge block 410-*i* (i=1, . . . , 8) is designed in a triangular shape. In one embodiment, each antenna edge block 410-*i* includes a low-noise amplifier (LNA), a phase shifter, and receive/transmit switches as shown, for example, in FIG. 2. The area of each triangular antenna edge block 410-*i* may be equal to the area of a rectangular antenna edge block (e.g., block 310-*i*) utilized in a conventional design.

To the base of each triangular antenna edge block 410-*i* an antenna interface 420-*i* (i=1, . . . , 8) is placed. As discussed above, the antenna interface implements a chip-board transition structure which typically includes the IC (chip) package and transmission lines, impedance matching, and ESD protection circuits. The vertexes of all the antenna edge blocks 410-1 through 410-8 are arranged to be directed to the center of a signal distribution network 430.

According to one embodiment, the signal distribution network 430 is designed in a star-like arrangement. Such an arrangement constitutes an even distribution of radio signals among the active antennas connected to each antenna interface 420-*i*. Specifically, the signal distribution network 430 requires only three signal splitter elements, one splitter to split the signal to antenna edge blocks in opposite edges of the layout, and the additional two splitters to distribute the signal to antenna edge blocks connected at each side of the rectangular layout. A splitter element is connected at each junction of the distribution network 430. As shown in FIG. 4, the distribution network 430 includes only three junctions (encircled and labeled as 431). In addition, the length of a transmission line of a distribution network 430 is half the length of the rectangular layout 400.

In an embodiment disclosed herein, the distribution network 430 is formed by connecting a transmission line having a length of half of the length of the rectangular IC layout 400 to a feed point 440, at one end, and to a 1:2 signal splitter at the other end. In addition, each output of the 1:2 signal splitters is connected to a 1:M/2 signal splitter, where M is the number of antenna edge blocks. Thus, in the exemplary and non-limiting IC layout, two 1:4 signal splitters are utilized to distribute the signal to edge blocks 410-1 through 410-4 and 410-5 through 410-8.

Figure 5:
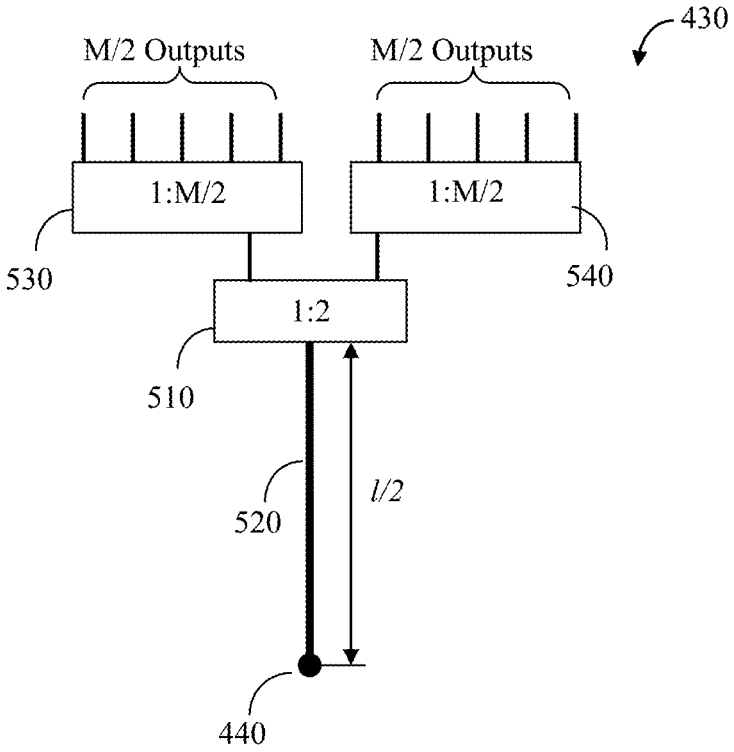
FIG. 5 is a diagram of a signal distribution network designed according to one embodiment.

An exemplary diagram of the distribution network 430 is shown in FIG. 5. The signal splitter 510 is a 1:2 splitter such that its input is connected to a transmission line 520 and its outputs are coupled to inputs of signal splitters 530 and 540. Each of the splitters 530 and 540 is a 1:M/2 signal splitter. As noted above, a signal splitter is a passive element that performs the functions of both signal summation and signal distribution.

It should be appreciated that the arrangement of the signal distribution network 430 and the antenna edge blocks 410 provide even distributions of the signals which thereby account for less signal losses. Furthermore, the disclosed arrangements enable reduction of the size of an RFIC in a millimeter wave RF module. When fabricating the antenna array connectivity circuit, the edge blocks, antenna interface and signal distribution network are arranged on a multilayer substrate according to the layout 400.

For the sake of simplicity of the description, the embodiments discussed with reference to FIG. 4 show only eight edge antenna blocks that allow connectivity to eight active antennas. However, the disclosed design techniques of including triangular antenna edge blocks in a rectangular layout can be adapted to allow connectivity to more than eight antennas.

Figure 6:
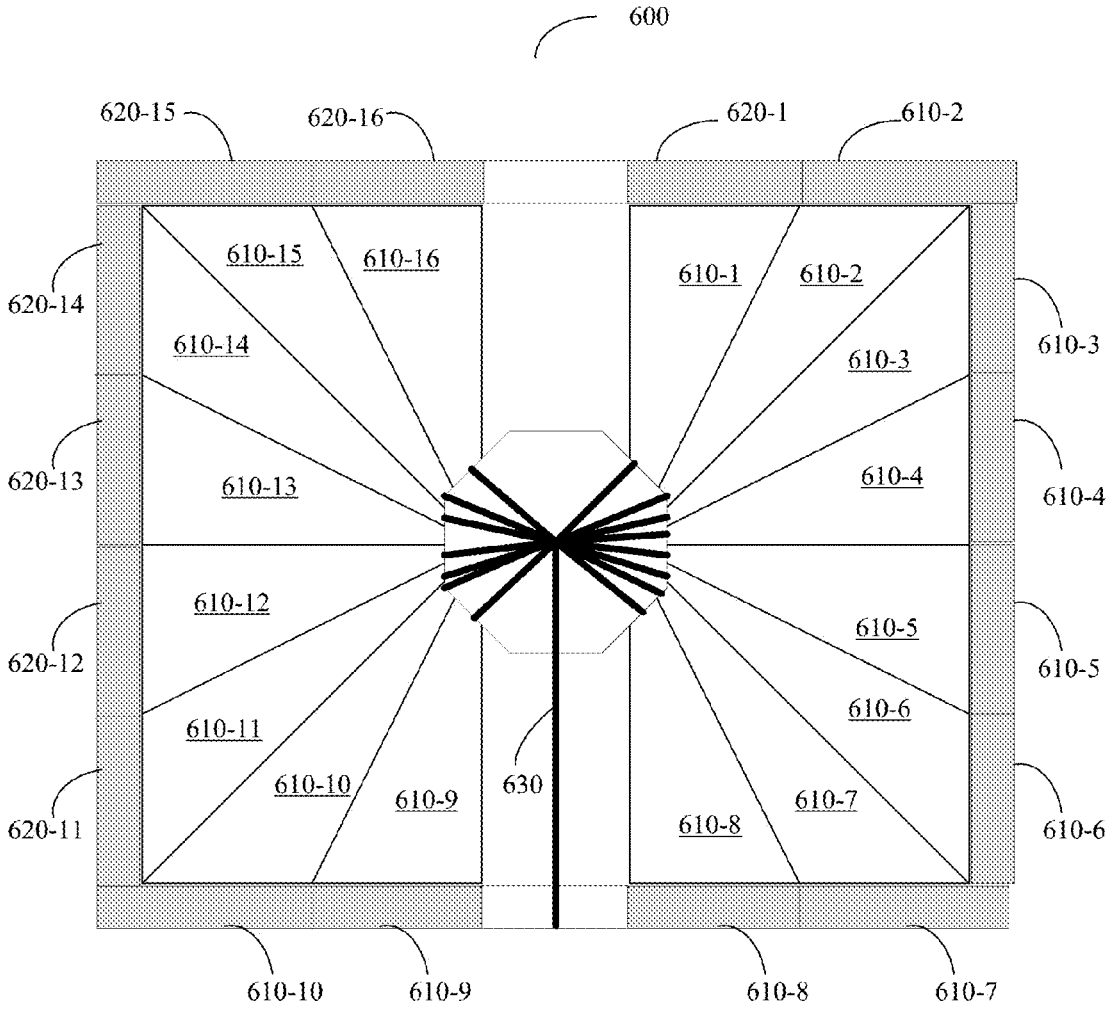
FIG. 6 illustrates an IC layout of antenna array connectivity according to another embodiment.

For example, FIG. 6 shows an exemplary diagram of an antenna array connectivity layout 600 that enables connectivity to 16 antennas. Specifically, the layout 600 includes 16 triangular antenna edge blocks 610-1, . . . , 610-16 each connected to a respective antenna interface 620-*i* (i=1, 2 . . . , 16) and a signal distribution network 630. In this embodiment, the length of a transmission line of the distribution network 630 is half of the length of the rectangular IC layout 600. To fit more edge blocks into the rectangular layout, the width of the layout 600 may be increased relative to the layout 400 while the length of both layouts remains the same. Alternatively, both the width and the length of the rectangular IC layout 600 can be increased relative to the layout 400. However, it should be emphasized that the total area of the IC layout 600 is smaller than an IC layout and RF circuitry designed to support 16 antennas using conventional design techniques.

In another embodiment, the number of antennas in the RF module can be increased by using two or more RF circuitry ICs designed according to the techniques disclosed herein. For example, four ICs, each having the IC layout 400 can be connected in an RF module to enable connectivity to an array of 32 active antennas. As another example, two ICs, each having the IC layout 600 can be connected in an RF module to enable connectivity to an array of 32 active antennas. In the embodiment where the RF module includes a number of antenna array connectivity circuits having the layouts discussed above, the feed point (e.g., feed point 440) can run through the diagonal of the layout in order to simplify signal routing in the entire RF module.

It should be noted that the size of an antenna array connectivity layout of an RF circuitry designed according to an embodiment is smaller than a conventional layout (e.g., IC layout 300). Thus the overall size of the RF module can remain the same even when including antenna array connectivity circuits in the RF module. Therefore, it should be appreciated that the techniques disclosed herein allow increasing the number of active antennas in an RF module and reducing the signal losses of receive/transmit signals. In a particular embodiment, the techniques disclosed herein can be utilized to design efficient millimeter-wave RF modules for 60 GHz signals, in which rigid constraints with regard to signal losses, size, and antenna diversity should be met.

In one embodiment, the remaining components of the RF circuitry, such as amplifiers and mixers can also be part of the antenna array connectivity layout. In this embodiment, one of the antenna edge blocks can be replaced with the remaining components of the RF circuitry which are also laid out in a triangular shape, thus maintaining the arrangement illustrated in FIGS. 4 and 6.

Figure 7:
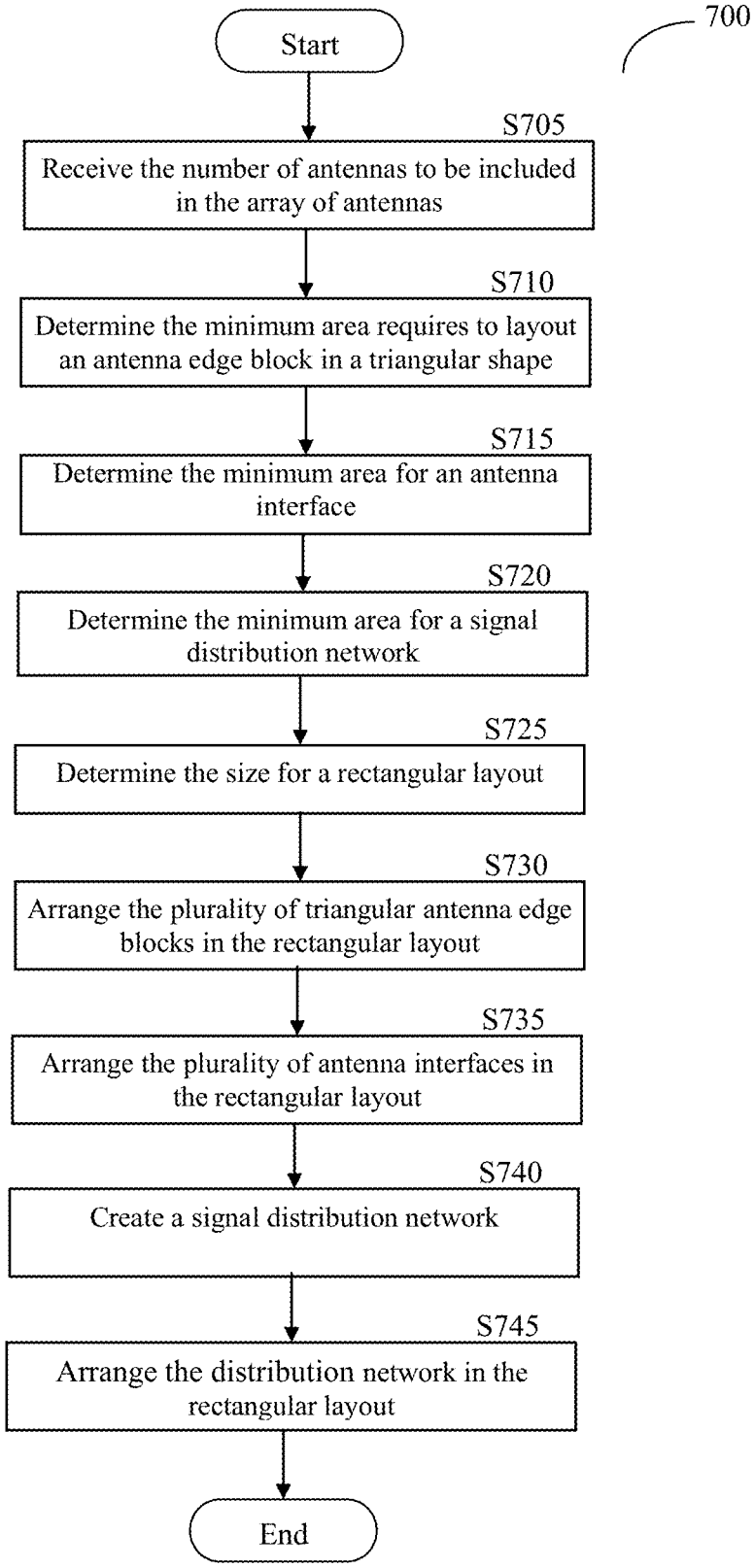
FIG. 7 is a flowchart illustrating a method for designing an antenna array connectivity IC layout according to one embodiment.

FIG. 7 shows an exemplary and non-limiting flowchart 700 of an antenna array connectivity layout design method according to one embodiment. As discussed in detail above, the antenna array connectivity is part of an RF circuitry and enables connectivity to an array of active antennas in the RF module. In a particular embodiment, the active antennas can be utilized to receive/transmit millimeter wave signals in the 60 GHz frequency band.

At S705, the number of active antennas to be included in the RF module that the antenna array connectivity circuits should support is received as an input. At S710, the minimum area required to arrange an antenna edge block in a triangle shape is determined. As noted above, an antenna edge block may include electrical components such as a LNA, a phase shifter, and the RX/TX switch. At S715, the minimum area required to arrange the circuits of an antenna interface is also determined. Each of the antenna interfaces to be included in the layout has a rectangular shape. At S720, the minimum area required for a signal distribution network is also determined. This is determined based on the size of the transmission line and splitter elements that are part of the distribution network.

At S725, a rectangular layout having a size determined by the accumulated space required to lay out a plurality of antenna edge blocks and antenna interfaces as well as the signal distribution network is created. The number of the plurality of antenna edge blocks and antenna interfaces are the same as the number of antennas in the array of antennas.

At S730, the plurality of triangular antenna edge blocks is arranged in the rectangular layout in such a way that the base of each edge block is parallel to an edge of the layout and its vertex points to the center of the layout. In one embodiment, the arrangement of the plurality of the antenna edge blocks includes spacing two equal groups of the antenna edge blocks near the area in which the signal distribution network is laid. This area is located in the center of the rectangular layout. At S735, the plurality of antenna interfaces is arranged. This includes placing each antenna interface parallel to a base of a respective triangular antenna edge block and in the perimeter of the layout.

At S740, a signal distribution network is created to allow routing the receive/transmit radio signals from/to each of the antenna edge blocks to a feed point. The creation of the distribution network includes connecting a transmission line having a length of half of the length of the rectangular layout to a feed point, at one end, and to a 1:2 signal splitter at the other end. Furthermore, each output of the 1:2 signal splitters is connected to a 1:M/2 signal splitter, where M is the number of the plurality antenna edge blocks received at S710. At S745, the created signal distribution network is arranged in the center area of the rectangular network in such a way that the 1:M/2 splitters are located in the center of the rectangular layout in close proximity to the vertexes of the plurality of antenna edge blocks.

In another embodiment, a general polygon-shape layout can be used as the perimeter of the IC layout. Thus, the rectangular layout can be replaced with a polygonal-layout, which may be constructed from triangles sharing a vertex.

The method described herein with reference to FIG. 7 can be implemented in an electronic design automation (EDA) system, a computer aided design (CAD) system or a CAD program and realized by operation of the system or program on a computer processor controlling a memory in which steps of the program are stored.

The various embodiments disclosed herein can be also implemented in as hardware, firmware, software, or any combination thereof. Moreover, the software is preferably implemented as an application program tangibly embodied on a program storage unit or computer readable medium consisting of parts, or of certain devices and/or a combination of devices. The application program may be uploaded to, and executed by, a machine comprising any suitable architecture. Preferably, the machine is implemented on a computer platform having hardware such as one or more central processing units ("CPUs"), a memory, and input/output interfaces. The computer platform may also include an operating system and microinstruction code. The various processes and functions described herein may be either part of the microinstruction code or part of the application program, or any combination thereof, which may be executed by a CPU, whether or not such computer or processor is explicitly shown. In addition, various other peripheral units may be connected to the computer platform such as an additional data storage unit and a printing unit. All or some of the servers may be combined into one or more integrated servers. Furthermore, a non-transitory computer readable medium is any computer readable medium except for a transitory propagating signal.

All examples and conditional language recited herein are intended for pedagogical purposes to aid the reader in understanding the principles of the invention and the concepts contributed by the inventor to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

What is claimed is:

1. An apparatus for wireless communication, comprising:

a polygon-shape layout of circuits arranged to enable connectivity of the circuits to an array of active antennas;

a plurality of triangular antenna edge blocks having a triangular layout arranged in the polygon-shape layout such that a base of each triangular antenna edge block of the plurality of triangular antenna edge blocks is parallel to an edge of the polygon-shape layout and a vertex of each triangular antenna edge block points to a center of the polygon-shape layout;

a plurality of antenna interfaces arranged in the polygon-shape layout such that each antenna interface of the plurality of antenna interfaces lays parallel to a base of a respective triangular antenna edge block and in a perimeter of one edge of the polygon-shape layout; and a signal distribution network located in the polygon-shape layout such that a separation is created between two groups of triangular antenna edge blocks.

2. The apparatus of claim 1, wherein the plurality of triangular antenna edge blocks and the plurality of antenna interfaces allow connectivity to the array of the active antennas, wherein a number of the plurality of triangular antenna edge blocks and a number of the plurality of antenna interfaces is the same as a number of active antennas in the array of active antennas.

3. The apparatus of claim 1, wherein the active antennas are configured to receive and transmit millimeter-wave radio signals.

4. The apparatus of claim 1, wherein a size of the polygon-shape layout is determined by accumulated space required to layout the plurality of triangular antenna edge blocks, the plurality of antenna interfaces, and the signal distribution network.

5. The apparatus of claim 1, wherein the signal distribution network is arranged in a star-like arrangement.

6. The apparatus of claim 5, wherein the signal distribution network comprises:

three signal splitters including a first 1-to-2 signal splitter, a second 1-to-K signal splitter, and a third 1-to-K signal splitter, wherein K is a half the number of the plurality of triangular antenna edge blocks; and a transmission line having a length half of a length of the polygon-shape layout, wherein the transmission line is coupled, at one end, to the first signal splitter and, at another end, to a feed point.

7. The apparatus of claim 1, further comprising a multilayer substrate having the polygon-shape layout formed therein.

8. The apparatus of claim 7, wherein the array of active antennas are printed on the multilayer substrate.

9. The apparatus of claim 1, wherein each triangular antenna edge block comprises at least one of an amplifier, one or more phase shifters, or one or more switches, and further wherein each antenna interface comprises a chip-board transition structure.

10. The apparatus of claim 1, wherein the polygon-shape layout comprises a rectangular layout.

11. A method for designing layout of an apparatus for wireless communication, comprising:

arranging a plurality of triangular antenna edge blocks having a triangular layout in a polygon-shape layout, wherein the plurality of triangular antenna edge blocks are arranged such that a base of each triangular antenna edge block of the plurality of triangular antenna edge blocks is parallel to an edge of the polygon-shape layout and a vertex of each triangular antenna edge block points to a center of the polygon-shape layout;

arranging a plurality of antenna interfaces in the polygon-shape layout such that an edge of each antenna interface of the plurality of antenna interfaces is parallel to a base of a respective triangular antenna edge block and in a perimeter of one edge of the polygon-shape layout; and arranging a signal distribution network in the center of the polygon-shape layout such that a separation is created between two groups of triangular antenna edge blocks.

12. The method of claim 11, wherein the plurality of triangular antenna edge blocks and the plurality of antenna interfaces allow connectivity to an array of active antennas, wherein a number of the plurality of the triangular antenna edge blocks and the plurality of antenna interfaces are the same as a number of active antennas in the array of active antennas.

13. The method of claim 11, further comprising:

determining a size of the polygon-shape layout as an accumulated area required to layout the plurality of triangular antenna edge blocks, the plurality of antenna interfaces, and the signal distribution network based on a minimum area required to layout each triangular antenna edge block, a minimum area required to layout each antenna interface, and a minimum area required to layout the signal distribution network.

14. The method of claim 11, wherein the signal distribution network is arranged in a star-like arrangement.

15. The method of claim 14, further comprising:

coupling a transmission line, at one end, to a first signal splitter of three signal splitters and, at another end, to a feed point, wherein a length of the transmission line is half of a length of the polygon-shape layout;

coupling an input of a second signal splitter out of the three signal splitters to a first output of the first signal splitter; and coupling an input of a third signal splitter out of the three signal splitters to a second output of the first signal splitter.

16. The method of claim 15, further comprising:

coupling K-outputs of the second signal splitter to a first group of triangular antenna edge blocks; and coupling K-outputs of the third signal splitter to a second group of triangular antenna edge blocks, wherein K is a half of the number of triangular antenna edge blocks.

17. The method of claim 11, wherein the polygon-shape layout comprises a rectangular layout.

18. A non-transitory computer-readable medium having code stored thereon for:

arranging a plurality of triangular antenna edge blocks having a triangular layout in the polygon-shape layout, wherein the plurality of triangular antenna edge blocks are arranged such that a base of each triangular antenna edge block of the plurality of triangular antenna edge blocks is parallel to an edge of a polygon-shape layout and a vertex of each triangular antenna edge block points to a center of the polygon-shape layout;

arranging a plurality of antenna interfaces in the polygon-shape layout such that an edge of each antenna interface of the plurality of antenna interfaces is parallel to a base of a respective triangular antenna edge block and in a perimeter of one edge of the polygon-shape layout; and arranging a signal distribution network in the center of the polygon-shape layout such that a separation is created between two groups of triangular antenna edge blocks.

19. A computer platform for designing layout of an apparatus for wireless communications, comprising:

one or more processors configured to:

arrange a plurality of triangular antenna edge blocks having a triangular layout in a polygon-shape layout, wherein the plurality of triangular antenna edge blocks are arranged such that a base of each triangular antenna edge block of the plurality of triangular antenna edge blocks is parallel to an edge of the polygon-shape layout and a vertex of each triangular antenna edge block points to a center of the polygon-shape layout;

arrange a plurality of antenna interfaces in the polygon-shape layout such that an edge of each antenna interface of the plurality of antenna interfaces lays is parallel to a base of a respective triangular antenna edge block and in a perimeter of one edge of the polygon-shape layout;

create a signal distribution network; and arrange the a signal distribution network in the center of the polygon-shape layout such that a separation is created between two groups of triangular antenna edge blocks; and a memory coupled with the one or more processors.

* * * * *